US007980304B2

(12) United States Patent
O'Brien

(10) Patent No.: US 7,980,304 B2
(45) Date of Patent: Jul. 19, 2011

(54) METHOD AND SYSTEM FOR EXTRACTION OF HYDROCARBONS FROM OIL SHALE

(75) Inventor: Thomas B. O'Brien, Blaine, WA (US)

(73) Assignee: Shale and Sands Oil Recovery LLC, St. Augustine, FL (US)

( * ) Notice: Subject to any disclaimer, the term of this patent is extended or adjusted under 35 U.S.C. 154(b) by 0 days.

(21) Appl. No.: 12/250,206

(22) Filed: Oct. 13, 2008

(65) Prior Publication Data

US 2009/0044943 A1 Feb. 19, 2009

Related U.S. Application Data

(63) Continuation of application No. 11/600,992, filed on Nov. 17, 2006, now Pat. No. 7,445,041.

(60) Provisional application No. 60/765,667, filed on Feb. 6, 2006.

(51) Int. Cl.

| | |
|---|---|
| ***E21B 36/04*** | (2006.01) |
| ***E21B 43/24*** | (2006.01) |
| ***E21B 43/26*** | (2006.01) |
| ***E21B 43/40*** | (2006.01) |

(52) U.S. Cl. ..... 166/247; 166/50; 166/60; 166/65.1; 166/248; 166/267; 166/272.2; 166/272.7; 166/302; 166/303; 166/308.1

(58) Field of Classification Search ..... 166/247
See application file for complete search history.

(56) References Cited

U.S. PATENT DOCUMENTS

| | | | | |
|---|---|---|---|---|
| 2,685,930 | A * | 8/1954 | Albaugh | 166/302 |
| 3,233,670 | A * | 2/1966 | Thompson et al. | 166/247 |
| 3,237,689 | A * | 3/1966 | Justheim | 376/275 |
| 3,246,695 | A * | 4/1966 | Robinson | 166/247 |
| 3,283,814 | A * | 11/1966 | Schlicht et al. | 376/275 |
| 3,598,182 | A * | 8/1971 | Justheim | 376/275 |
| 3,766,982 | A * | 10/1973 | Justheim | 166/261 |
| 4,000,038 | A | 12/1976 | Moser | |
| 4,124,074 | A | 11/1978 | Allen et al. | |
| 4,144,935 | A * | 3/1979 | Bridges et al. | 166/248 |
| 4,384,614 | A * | 5/1983 | Justheim | 166/259 |
| 4,678,039 | A | 7/1987 | Rivas et al. | |
| 5,124,008 | A | 6/1992 | Rendall et al. | |
| 7,445,041 | B2 * | 11/2008 | O'Brien | 166/247 |
| 2003/0146002 | A1 | 8/2003 | Vinegar et al. | |
| 2007/0095536 | A1 * | 5/2007 | Vinegar et al. | 166/302 |
| 2007/0293404 | A1 * | 12/2007 | Hutchins et al. | 507/211 |

OTHER PUBLICATIONS

Brain, Marshall, and Robert Lamb. "How Nuclear Power Works" Oct. 9, 2000. HowStuffWorks.com. <http://science.howstuffworks.com/nuclear-power.htm> Sep. 23, 2010.*

* cited by examiner

*Primary Examiner* — George Suchfield
(74) *Attorney, Agent, or Firm* — Mark Leonardo; Lillian Horwitz; Brown Rudnick LLP

(57) ABSTRACT

A system and method for extracting hydrocarbon products from oil shale using nuclear energy sources for energy to fracture the oil shale formations and provide sufficient heat and pressure to produce liquid and gaseous hydrocarbon products. Embodiments of the present invention also disclose steps for extracting the hydrocarbon products from the oil shale formations.

3 Claims, 11 Drawing Sheets

METHOD AND SYSTEM FOR EXTRACTION OF HYDROCARBONS FROM OIL SHALE

CROSS REFERENCE TO RELATED APPLICATION

This patent application claims the benefit of U.S. Provisional Patent Application Ser. No. 60/765,667, filed on Feb. 6, 2006 and is a continuation application to U.S. Utility patent application Ser. No. 11/600,992, filed on Nov. 17, 2006, now U.S. Pat. No. 7,445,041 the entire contents of each of these applications being incorporated herein by reference in its entirety.

FIELD OF THE INVENTION

The present invention relates to using alternative energy sources to create a method and system that minimizes the cost of producing useable hydrocarbons from hydrocarbon-rich shales or "oil shales". The advantageous design of the present invention, which includes a system and method for the recovery of hydrocarbons, provides several benefits including minimizing energy input costs, limiting water use and reducing the emission of greenhouse gases and other emissions and effluents, such as carbon dioxide and other gases and liquids.

BACKGROUND OF THE INVENTION

Discovery of improved and economical systems and methods for extracting hydrocarbons from organic-rich rock formations, such as oil shale, has been a challenge for many years. Historically, a substantial amount of hydrocarbons are produced from subterranean reservoirs.

The reservoirs can include organic-rich shale from which the hydrocarbons derive. The shale contains a hydrocarbon precursor known as kerogen. Kerogen is a complex organic material that can mature naturally to hydrocarbons when it is exposed to temperatures over 100° C. This process, however, can be extremely slow and takes place over geologic time.

Immature oil shale formations are those that have yet to liberate their kerogen in the form of hydrocarbons. These organic rich rock formations represent a vast untapped energy source. The kerogen, however, must be recovered from the oil shale formations, which under prior known methods can be a complex and expensive undertaking, which may have a negative environmental impact such as greenhouse gases and other emissions and effluents, such as carbon dioxide and other gases and liquids.

In a known method, kerogen-bearing oil shale near the surface can be mined and crushed and, in a process known as retorting, the crushed shale can then be heated to high temperatures to convert the kerogen to liquid hydrocarbons. There are, however, a number of drawbacks to surface production of shale oil including high costs of mining, crushing, and retorting the shale and a negative environmental impact, which also includes the cost of shale rubble disposal, site remediation and cleanup. In addition, many oil shale deposits are at depths that make surface mining impractical.

Attempts have been made to overcome the drawbacks of prior known methods of recovery by employing in situ (i.e., "in place") processes. In situ processes can include techniques whereby the kerogen is subjected to in situ heating through combustion, heating with other material or by electric heaters and radio frequencies in the shale formation itself. The shale is retorted and the resulting oil drained to the bottom of the rubble such that the oil is produced from wells. In still other attempts, in situ techniques have been described that include fracturing and heating the shale formations underground to release gases and oils. These types of techniques typically require finished hydrocarbons to produce thermal and electric energy and heat the shale, and may employ conventional hydro-fracturing techniques or explosive materials. These attempts, however, also continue to suffer from disadvantages such as negative environmental impacts, high fuel costs to produce thermal energy for heating and/or electricity, as well as high water consumption. In addition, these methods may have a negative environmental impact such as greenhouse gases and other emissions and effluents, such as carbon dioxide and other gases and liquids.

Therefore, it would be desirable to overcome the disadvantages and drawbacks of the prior art with a method and system for recovering hydrocarbon products from rock formations, such as oil shale, which heat the oil shale via thermal or electrically induced energy produced by a nuclear reactor. It would be desirable if the method and system can accelerate the maturation process of the precursors of crude oil and natural gas. It is most desirable that the method and system of the present invention is advantageously employed to minimize energy input costs, limit water use and reduce the emission of greenhouse gases and other emissions and effluents, such as carbon dioxide and other gases and liquids.

SUMMARY OF THE INVENTION

Accordingly, a method and system is disclosed for recovering hydrocarbon products from rock formations, such as oil shale, which heat the oil shale via thermal energy produced by a nuclear reactor for overcoming the disadvantages and drawbacks of the prior art. Desirably, the method and system can accelerate the maturation process of the precursors of crude oil and natural gas. The method and system may be advantageously employed to minimize energy input costs, limit water use and reduce the emission of greenhouse gases and other emissions and effluents, such as carbon dioxide and other gases and liquids.

In the method and system it is contemplated that supercritical material will be injected into the formation to produce fracturing and porosity that will maximize the production of useful hydrocarbons from the oil shale formation.

In one particular embodiment, in accordance with the present disclosure, a method for recovering hydrocarbon products is provided. The method includes the steps of: producing thermal energy using a nuclear reactor; providing the thermal energy to a hot gas generator; providing a gas to the hot gas generator; producing a high pressure hot gas flow from the hot gas generator using a high pressure pump; injecting the high pressure hot gas flow into injection wells wherein the injection wells are disposed in an oil shale formation; retorting oil shale in the shale oil formation using heat from the hot gas flow to produce hydrocarbon products; and extracting the hydrocarbon products from the recovery well.

In an alternate embodiment, the method includes the steps of: generating electricity using a nuclear powered steam turbine; retorting oil shale in a shale oil formation using electric heaters powered by the electricity to produce hydrocarbon products; and extracting the hydrocarbon products from the injection well.

In another alternate embodiment, the method includes the steps of: producing thermal energy using a nuclear reactor; providing the thermal energy to a molten salt or liquid metal generator; providing a salt or metal to the molten salt or liquid metal generator; producing a molten salt or liquid metal flow from the molten salt or liquid metal generator using a pump; injecting the molten salt or liquid metal flow into bayonet injection wells wherein the injection wells are disposed in an oil shale formation; retorting oil shale in the shale oil formation using heat from the molten salt or liquid metal flow to produce hydrocarbon products; and extracting the hydrocarbon products from the recovery well.

In another alternate embodiment, the method includes the steps of: generating electricity using a nuclear powered steam turbine; retorting oil shale in a shale oil formation using radio frequencies powered by the electricity to produce hydrocarbon products; and extracting the hydrocarbon products from the recovery well.

The present invention provides a system and method for extracting hydrocarbon products from oil shale using nuclear reactor sources for energy to fracture the oil shale formations and provide sufficient heat and/or electric power to produce liquid and gaseous hydrocarbon products. Embodiments of the present invention also disclose steps for extracting the hydrocarbon products from the oil shale formations.

Oil shale contains the precursors of crude oil and natural gas. The method and system can be employed to artificially speed the maturation process of these precursors by first fracturing the formation using supercritical materials to increase both porosity and permeability, and then heat the shale to increase the temperature of the formation above naturally occurring heat created by an overburden pressure. The use of a nuclear reactor may reduce energy input cost as compared to employing finished hydrocarbons to produce thermal energy and/or electricity. Nuclear reactors produce the supercritical temperature in the range from 200° to 1100° C. (depending on the material to be used) necessary for increasing the pressure used in the fracturing process compared to conventional hydro fracturing and/or the use of explosives. In oil shale, the maximization of fracturing is advantageous to hydrocarbon accumulation and recovery. Generally, massive shales in their natural state have very limited permeability and porosity.

In addition, limiting water use is also beneficial. The use of large quantities of water has downstream implications in terms of water availability and pollution. The method and system may significantly reduce water use.

Further, the use of natural gas/coal/oil for an input energy source creates greenhouse gases and other emissions and effluents, such as carbon dioxide and other gases. An increasingly large number of earth scientists believe that greenhouse gases contribute to a phenomenon popularly described as "global warming". The method and system of the present disclosure can significantly reduce the emission of greenhouse gases.

BRIEF DESCRIPTION OF THE DRAWINGS

The present invention, both as to its organization and manner of operation, will be more fully understood from the following detailed description of illustrative embodiments taken in conjunction with the accompanying drawings in which.

DETAILED DESCRIPTION

The exemplary embodiments of the method and system for extracting hydrocarbon products using alternative energy sources to fracture oil shale formations and heat the shale to produce liquid and gaseous hydrocarbon products are discussed in terms of recovering hydrocarbon products from rock formations and more particularly, in terms of recovering such hydrocarbon products from the oil shale via thermal energy produced by a nuclear reactor. The method and system of recovering hydrocarbons may accelerate the maturation process of the precursors of crude oil and natural gas. It is contemplated that such a method and system as disclosed herein can be employed to minimize energy input costs, limit water use and reduce the emission of greenhouse gases and other emissions and effluents, such as carbon dioxide and other gases and liquids. The use of a nuclear reactor to produce thermal energy reduces energy input costs and avoids reliance on finished hydrocarbon products to produce thermal energy and the related drawbacks associated therewith and discussed herein. It is envisioned that the present disclosure may be employed with a range of recovery applications for oil shale extraction including other in situ techniques, such as combustion and alternative heating processes, and surface production methods. It is further envisioned that the present disclosure may be used for the recovery of materials other than hydrocarbons or their precursors disposed in subterranean locations.

Figure 1:
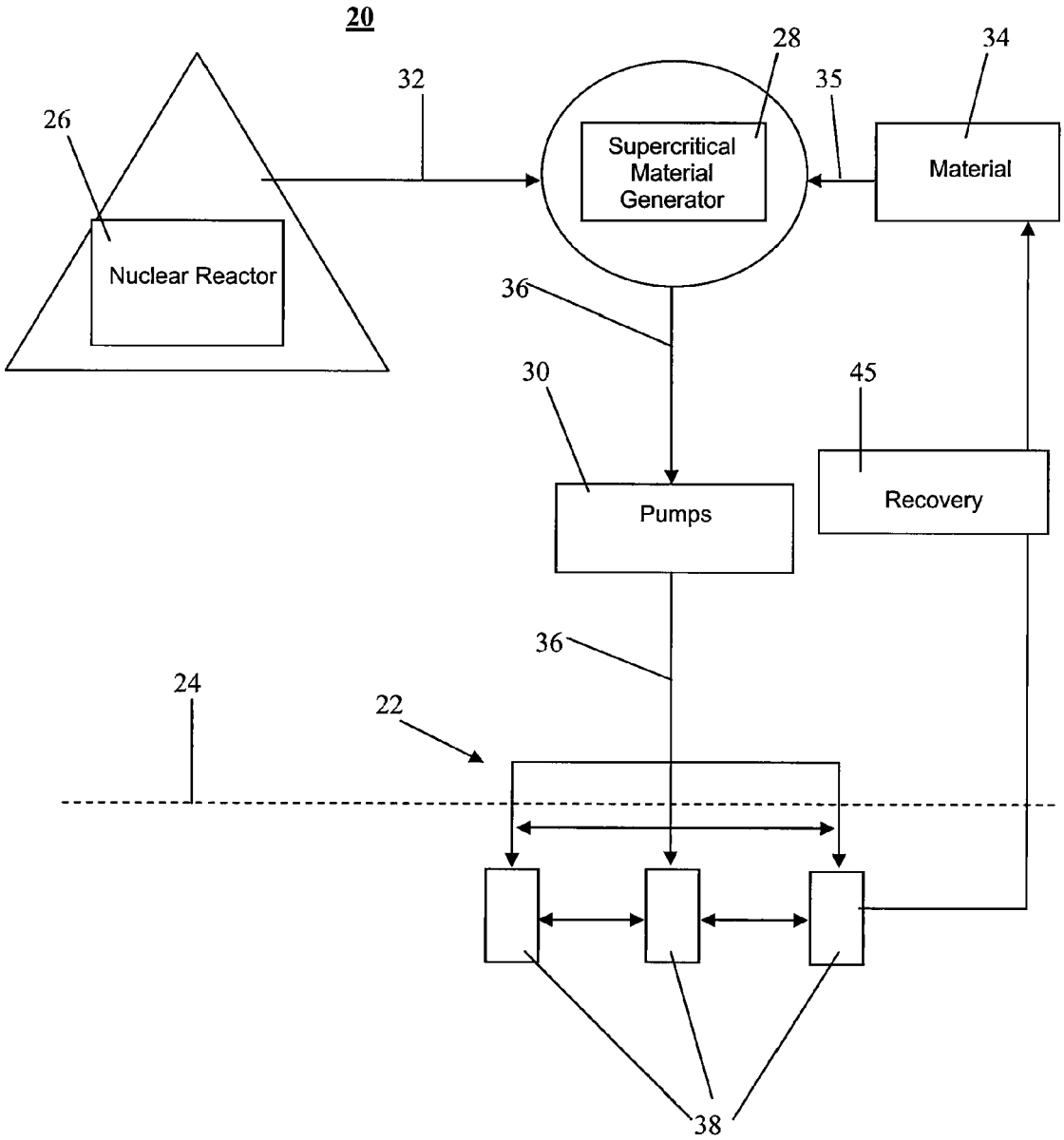
FIG. 1 is a schematic diagram of a method and system for fracturing oil shale using a nuclear energy source in accordance with the principles of the present invention.

The following discussion includes a description of the method and system for recovering hydrocarbons in accordance with the principles of the present disclosure. Alternate embodiments are also disclosed. Reference will now be made in detail to the exemplary embodiments of the present disclosure, which are illustrated in the accompanying figures. Turning now to FIG. 1, there is illustrated a method and system for recovering hydrocarbon products, such as, for example, a system 20 for fracturing and retorting oil shale using a nuclear reactor and an associated thermal transfer system, in accordance with the principles of the present disclosure.

The nuclear reactor and thermal components of system 20 are suitable for recovery applications. Examples of such nuclear reactor and thermal components are provided herein, although alternative equipment may be selected and/or preferred, as determined by one skilled in the art.

Detailed embodiments of the present disclosure are disclosed herein, however, it is to be understood that the described embodiments are merely exemplary of the disclosure, which may be embodied in various forms. Therefore, specific functional details disclosed herein are not to be interpreted as limiting, but merely as a basis for the claims and as a representative basis for teaching one skilled in the art to variously employ the present disclosure in virtually any appropriately detailed embodiment.

In one aspect of system 20 and its associated method of operation, an oil shale extraction site 22 is selected for recovery of hydrocarbon products and treatment of the precursors of oil and gas. Site selection will be based on subsurface mapping using existing borehole data such as well logs and core samples and ultimately data from new holes drilled in a regular grid. Areas with higher concentrations of relatively mature kerogen and lithology favorable to fracturing will be selected. Geophysical well log data where available, including resistivity, conductivity, sonic logs and so on will be employed. Seismic data is desirable; however, core analysis is a reliable method of determining actual porosity and permeability which is related to both efficient heating and extraction of the end product, usable hydrocarbons. Grain size and distribution is also desirable as shales give way to sands. Areas where there is high drilling density and reliable data with positive indications in the data would be ideal. Geochemical analysis is also desirable to the process as shales tend to have very complicated geochemical characteristics. Surface geochemistry is desirable in a localized sense. Structural features and depositional environments are desirable in a more area or regional sense. Reconstruction of depositional environments and post-depositional dynamics are desirable. For instance, oil shales along the central coast of California feature a great deal of natural fracturing due to post-depositional folding and fracturing of the beds. Three dimensional computer modeling provided there is enough accurate data would be desirable. As experience is gained in the optimal parameters for exploitation, the entire process and system can be modulated in its application to different sub-surface environments. At selected site 22, a surface level 24 is drilled for extraction of core samples (not shown) using suitable drilling equipment for a rock formation application, as is known to one skilled in the art. The core samples are extracted from site 22 and geological information is taken from the core samples. These core samples are analyzed to determine if site 22 selected is suitable for recovery of hydrocarbons and treatment of the precursors of oil and gas.

If the core samples have the desired characteristics, site 22 will be deemed suitable for attempting to extract hydrocarbons from oil shale. Accordingly, a strategy and design is formulated for constructing fracturing wells and retort injection wells, as will be discussed below. Joints, fractures and depositional weaknesses will be exploited in order to maximize the effect of this method of fracturing. Ideally areas can be identified which have experienced a relatively higher degree of naturally occurring fracturing due to folding and faulting as observed in the coastal areas of central California. Piping arrays will be oriented in concert with these existing weaknesses in order to create the maximum disruption of the rock matrix. The nuclear reactor placement will also be formulated and planned for implementation, as well any other infrastructure placements necessary for implementation of the system and method. It is contemplated that if the core samples taken from the selected site are not found to have the desired characteristics, an alternate site may be selected. Site 22 is also prepared for installation and related construction of a supercritical material generator 28 and other components including high pressure pumps 30 and drilling equipment (not shown).

In another aspect of system 20, installation and related construction of nuclear reactor 26 and the components of the thermal transfer system at site 22 is performed. Plumbing equipment (not shown) is constructed and installed. A material supply 34 is connected to the plumbing equipment and the components of the thermal transfer system. Electrical equipment (not shown) is wired and installed. Off-site electric connections (if available) are made to the electrical equipment. If off-site electric connections are not available, then a small stream of energy from the nuclear reactor may be generated using a conventional electric generator (not shown). It is contemplated that plumbing equipment and electrical equipment are employed that are suitable for an oil shale extraction application and more particularly, for recovery of hydrocarbons and treatment of their precursors, as is known to one skilled in the art.

It is envisioned that nuclear reactor 26 may be a small or large scale nuclear reactor employed with system 20 in accordance with the principles of the present disclosure. Nuclear reactor 26 is a thermal source used to provide thermal energy 32 to fracture an oil shale formation (not shown). Nuclear reactor 26 is sized to be located at or near the oil shale formation of site 22. It is envisioned that the thermal rating of nuclear reactor 26 is between 20 MWth to 3000 MWth. For example, a nuclear reactor, such as the Toshiba 4S reactor, may be used. These reactors can include all generation III, III+ and IV reactors, including but not limited to Pressurized Water Reactors, Boiling Water Reactors, CANDU reactors, Advanced Gas Reactors, ESBWR, Very High Temperature Reactors, helium or other gas cooled reactors, liquid sodium cooled reactors, liquid lead cooled rectors or other liquid metal cooled reactors, molten salt reactors, Super Critical Water Reactors, and all next generation nuclear plant designs.

Supercritical material generator 28 is constructed and installed at site 22. Nuclear reactor 26 is coupled to supercritical material generator 28, as is known to one skilled in the art, for the transfer of thermal energy 32. Material supply source 34 delivers material 35 to supercritical material generator 28. System 20 employs supercritical material generator 28, in cooperation with nuclear reactor 26 as the thermal source, to produce supercritical material 36 for fracturing oil shale formations. It is contemplated that a number of materials may be generated by supercritical material generator 28 for fracturing, such as water, carbon dioxide and nitrogen, among others.

The use of supercritical material 36 is employed to enhance permeability and porosity of the oil shale formation through fracturing. Studies have shown that supercritical material can be effectively used to permeate and fracture rock formations. (See, e.g., 14th International Conference on the Properties of Water and Steam in Kyoto, Sergei Fomin*, Shin-ichi Takizawa and Toshiyuki Hashida, Mathematical Model of the Laboratory Experiment that Simulates the Hydraulic Fracturing of Rocks under Supercritical Water Conditions, Fracture and Reliability Research Institute, Tohoku University, Sendai 980-8579, Japan), which is incorporated herein in its entirety. Other supercritical material has been used in other applications.

Systems to manage the extremely high pressures must be installed in order to safely operate the entire apparatus. Placement of blowout preventers and pressure relief valves will be integrated into the system and carefully monitored particularly at the outset of testing the process.

High pressure pumps 30 are installed at site 22 and coupled to supercritical material generator 28 for injecting supercritical material 36 into the oil shale formations. High pressure pumps 30 deliver supercritical material 36 to oil shale fracturing wells 38 at high pressure. Supercritical material 36 is delivered at high pressures to the oil shale formations to achieve maximum permeability in the shale. It is envisioned that high pressure pumps 30 deliver pressures in the range between 50 and 500 MPa or higher. These pumps may be centrifugal or other types of pumps. The high pressure pumps and required remote pumping stations (not shown) may be designed for remote operation using the pipeline SCADA (Supervisory Control And Data Acquisition) systems and may be equipped with protection equipment such as intake and discharge pressure controllers and automatic shutoff devices in case of departure from design operating conditions.

It is further envisioned that an optimal injection parameters can be determined based on the formation characteristics and other factors. Geologic environments can vary locally and regionally. As well as discussed above, System 20 may include various high pressure pump configurations such as a series of multiple pumps to achieve optimal results. The described supercritical material distribution system is constructed and installed at site 22, as is known to one skilled in the art. All systems are tested and a shakedown integration is performed.

Figure 2:
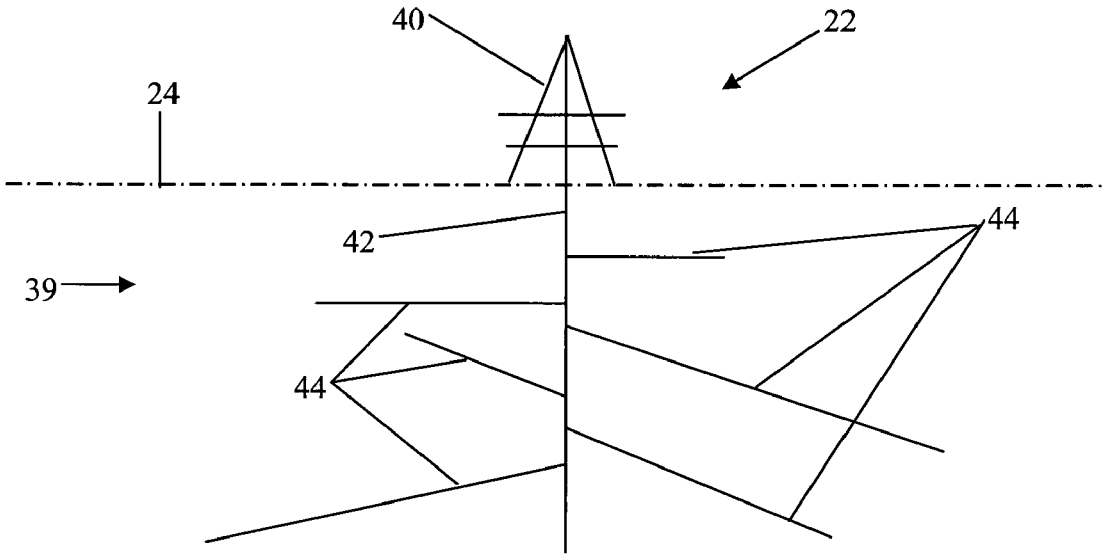
FIG. 2 is a schematic diagram of directionally drilled shafts used at an extraction site, in accordance with the principles of the present invention.

An infrastructure 39 for fracturing wells 38 (FIG. 1) is constructed at site 22, as shown in FIG. 2. A drilling rig 40 with equipment designed for accurate directional drilling is brought on site. It will be very important to accurately determine the location of the bit while drilling. Many recent innovations in rig and equipment design make this possible. Rigs may be leased on a day or foot rate and are brought in piece by piece for large rigs and can be truck mounted for small rigs. Truck mounted rigs can drill to depths of 2200 feet or more 24 of site 22, as is known to one skilled in the art. Drilling rig 40 is disposed adjacent a vertical drill hole 42 from which horizontal drill holes 44, which may be disposed at orthogonal, angular or non-orthogonal orientations relative to vertical drill hole 42, are formed. Oil shale fracturing wells 38 are installed with infrastructure 39 of site 22. Oil shale fracturing wells 38 inject supercritical material 36 into drill holes 42, 44 of the oil shale formation and site 22.

Directional drilling is employed to maximize the increase in permeability and porosity of the oil shale formation and maximize the oil shale formation's exposure to induced heat. The configuration of horizontal drill holes 44 can be formulated based on geological characteristics of the oil shale formation as determined by core drilling and geophysical investigation. These characteristics include depositional unconformities, orientation of the bedding planes, schistosity, as well as structural disruptions within the shales as a consequence of tectonics. Existing weaknesses in the oil shale formations may be exploited including depositional unconformities, stress fractures and faulting.

Figure 3:
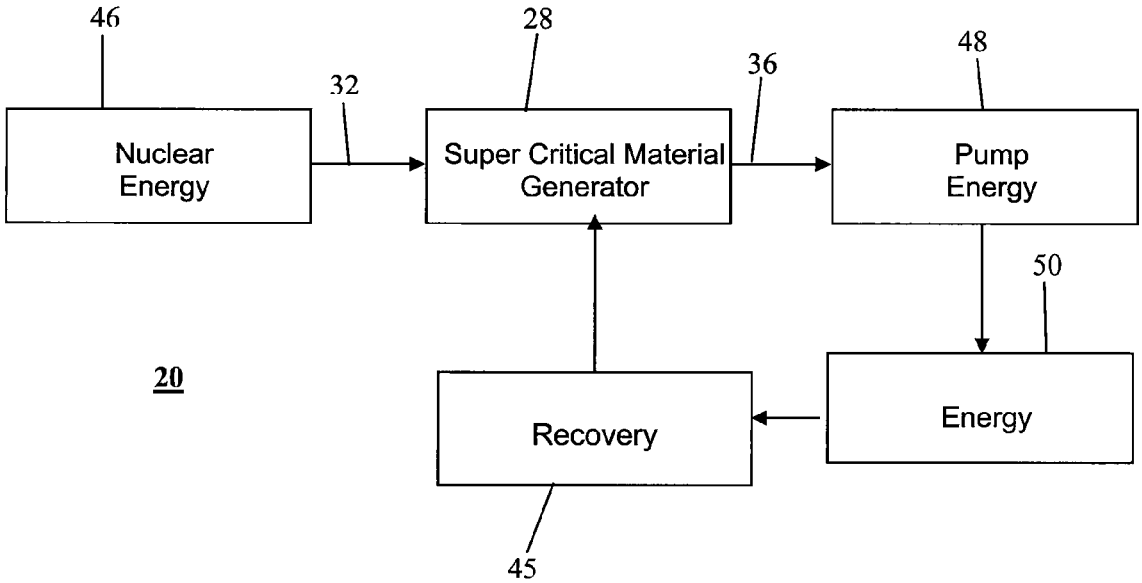
FIG. 3 is a process energy flow diagram of the method and system shown in FIG. 1.

An illustration of the energy flow of system 20 for oil shale fracturing operations (FIG. 1), as shown in FIG. 3, includes nuclear energy 46 generated from nuclear reactor 26. Nuclear energy 46 creates thermal energy 32 that is transferred to supercritical material generator 28 for producing supercritical material 36. Supercritical material 36 is delivered to high pressure pumps 30. Pump energy 48 puts supercritical material 36 under high pressure.

High pressure pumps 30 deliver supercritical material 36 to fracturing wells 38 with sufficient energy 50 to cause fracturing in the oil shale formations. Such fracturing force increases porosity and permeability of the oil shale formation through hydraulic stimulation under supercritical conditions. Residual supercritical materials from the fracturing operations are recovered via a material recovery system 45 and re-introduced to supercritical material generator 28 via material supply 34 using suitable conduits, as known to one skilled in the art. It is envisioned that a material recovery system is employed to minimize the consumption of material used to fracture the oil shale formation. A recycling system may be deployed in order to also minimize any groundwater pollution and recycle material where possible.

In another aspect of system 20, the fracturing operations employing the supercritical material distribution system described and oil shale fracturing wells 38 are initiated. Nuclear reactor 26 and the material distribution system are run. Fracturing of the oil shale formations via wells 38 is conducted to increase permeability and porosity of the oil shale formation for heat inducement. The fracturing process in the oil shale formation at site 22 is tracked via readings taken. Based on these reading values, formulations are conducted to determine when the fracturing is advanced to a desired level. One method of determining the level of fracturing would be take some type of basically inert material, circulate it downhole, and read the amount and rate of material loss. In other words, measure the "leakage" into the formation. Gases may also be employed with the amount of pressure loss being used to measure the degree of fracturing. These measurements would be compared to "pre-fracturing" level. This method would be particularly helpful in the case of microfracturing. Core samples are extracted from the fractured oil shale formation. These samples are analyzed. The analysis results are used to formulate and plan for implementation of a drilling scheme for the injection wells for retort and perforation wells for product recovery.

In another aspect of system 20, oil shale fracturing wells 38 are dismantled from infrastructure 39. Initially, operation of nuclear reactor 26 is temporarily discontinued in cold or hot shutdown depending on the particular reactor's characteristics. Oil shale fracturing wells 38 are dismantled and removed from infrastructure 39 of site 22. Retort wells and perforation recovery wells (not shown) are constructed with infrastructure 39, in place of the oil shale fracturing wells 38, and installed at site 22 for connection with drill holes 42, 44. Exemplary embodiments of retort systems for use with system 20, in accordance with the principles of the present disclosure, will be described in detail with regard to FIGS. 4-11 discussed below.

The retort wells transfer heated materials to the fractured oil shale formations for heat inducement. The exposure of the oil shale to heat in connection with high pressure accelerates the maturation of the hydrocarbon precursors, such as kerogen, which forms liquefied and gaseous hydrocarbon products. During the retort operations, hydrocarbons accumulate. A suitable recovery system is constructed for hydrocarbon recovery, as will be discussed. Nuclear reactor 26 is restarted for retort operations, as described. All systems are tested and a shakedown integration is performed.

Figure 4:
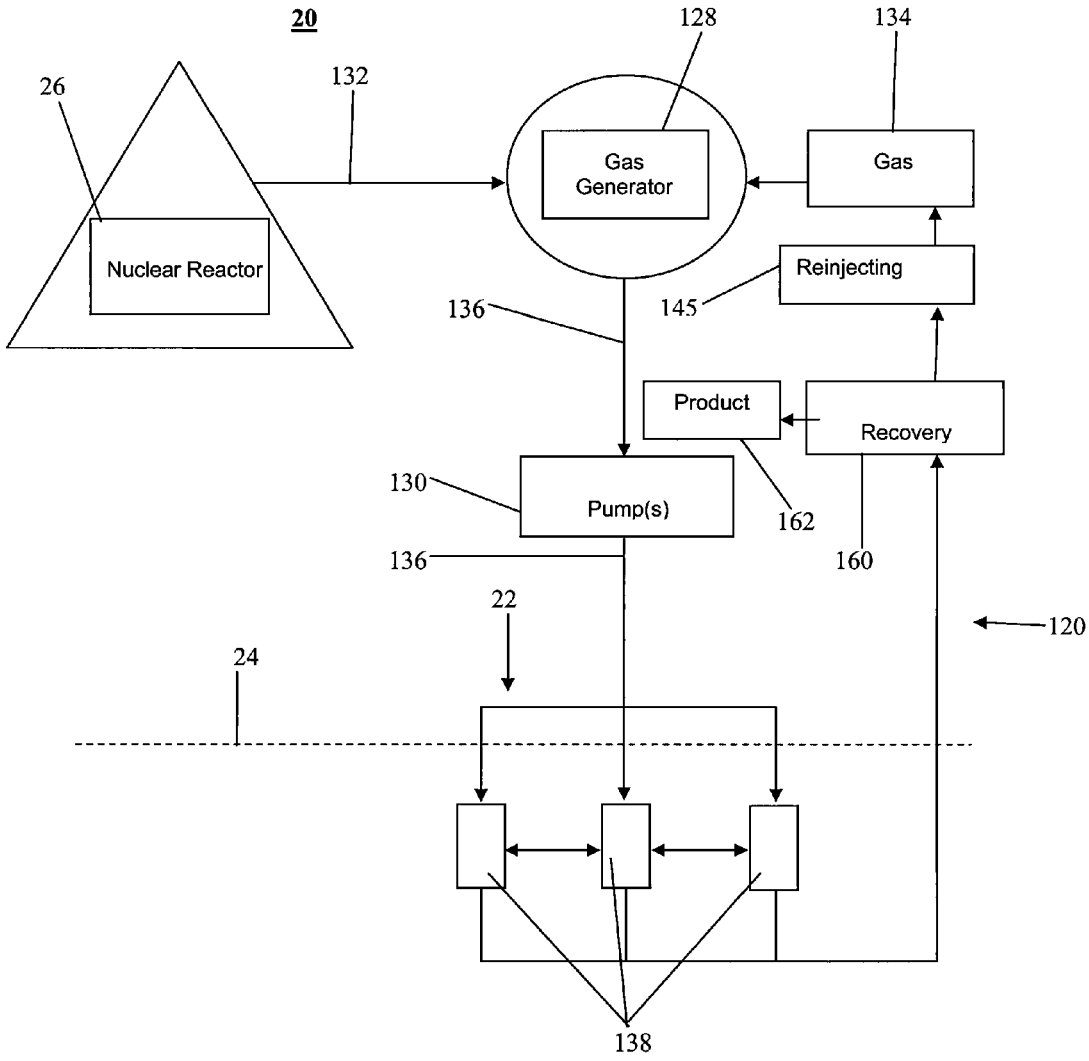
FIG. 4 is a schematic diagram of a method and system for retorting oil shale using a nuclear energy source in accordance with the principles of the present invention.

In another aspect of system 20, the retort operations employing the retort wells and perforation recovery wells are initiated for product recovery. The retort wells and the perforation wells are run and operational. In one particular embodiment, as shown in FIG. 4, system 20 includes a retort system 120 for retort operations relating to the fractured oil shale formations at site 22, similar to that described with regard to FIGS. 1-3. Site 22 is prepared for installation and related construction of retort system 120, which includes gas handling equipment and thermal transfer system components, which will be described.

Retort system 120 employs hot gases that are injected into the fractured oil shale formations to induce heating and accelerate the maturation process of hydrocarbon precursors as discussed. Nuclear reactor 26 discussed above, is a thermal source that provides thermal energy 132 to retort the oil shale formation in-situ. Nuclear reactor 26 is sized to be located at or near site 22 of the fractured oil shale formation. It is envisioned that the thermal rating of nuclear reactor 26 is between 20 MWth to 3000 MWth. It is further contemplated that hydrogen generated by nuclear reactor 26 can be used to enhance the value of carbon bearing material, which may resemble char and be recoverable. A hydrogen generator (not shown), either electrolysis, thermal or other may be attached to the nuclear reactor 26 to generate hydrogen for this use.

A gas injection system 134 is installed at site 22. Gas injection system 134 delivers gas to a hot gas generator 128. Hot gas generator 128 is constructed and installed at site 22. There are many types of hot gas generators available for this type of application including, but not limited to boilers and the like. Nuclear reactor 26 is coupled to hot gas generator 128, as is known to one skilled in the art, for the transfer of thermal energy 132. System 20 employs hot gas generator 128, in cooperation with nuclear reactor 26 as the thermal source, to produce hot gas 136 for retort of the fractured oil shale formations.

It is envisioned that the thermal output of nuclear reactor 26 can be used to heat various types of gases for injection to retort the oil shale formations such as air, carbon dioxide, oxygen, nitrogen, methane, acetic acid, steam or other appropriate gases other appropriate combinations. Other gases can also be injected secondarily to maximize the retort process if appropriate.

High pressure pumps 130 are installed at site 22 and coupled to hot gas generator 128 for injecting hot gas 136 into the fractured oil shale formations. High pressure pumps 130 put hot gas 136 into a high pressure state to promote the retort of the oil shale formations. It is envisioned that system 20 may include various high pressure pump configurations including multiple pumps and multiple gases to maximize the effectiveness of the retort operation.

Oil shale asset heating retort injection wells 138 are installed with the infrastructure of system 20, as discussed. Hot gas 136 is transferred to injection wells 138 and injected into the fractured oil shale formation. The use of horizontal drilling described with regard to FIG. 3, can be employed to maximize the oil shale formation's exposure to heat necessary to form both gaseous and liquefied hydrocarbons. It may take between 2-4 years for the formation of sufficient kerogen to be commercially recoverable. After that recovery may occur on a commercial level for between 3-30 years or more.

Figure 5:
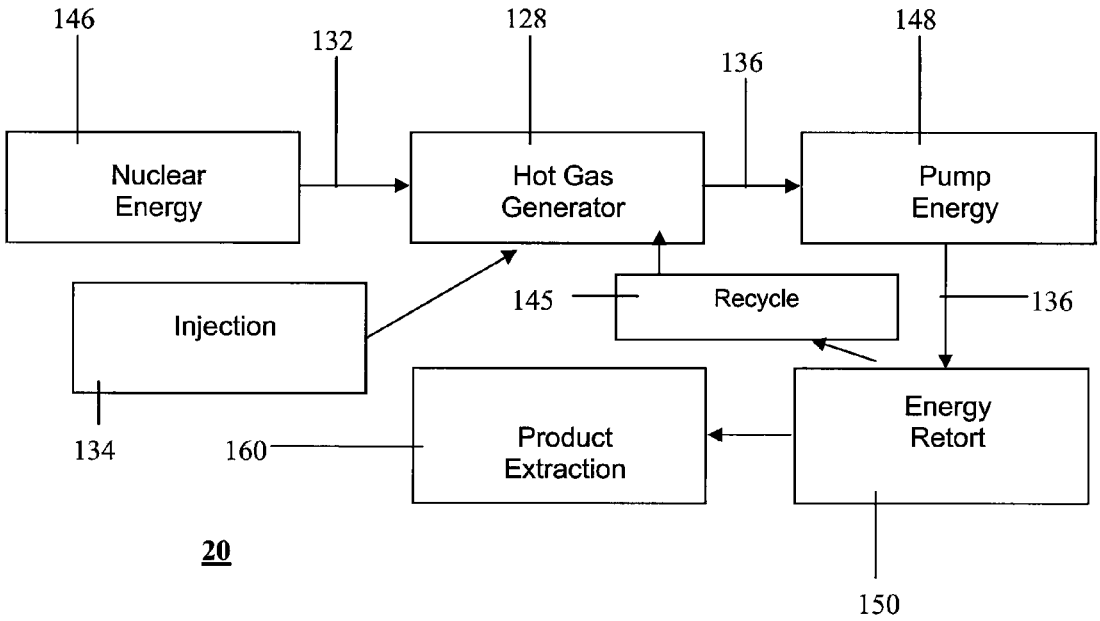
FIG. 5 is a process energy flow diagram of the method and system shown in FIG. 4.

A product recovery system 160 is constructed at site 22. Product recovery system 160 may be a conventional hydrocarbon recovery system or other suitable system that addresses the recovery requirements and is coupled with perforation recovery wells 120 (not shown) for collection of gaseous and liquefied hydrocarbons that are released during the retort process. An illustration of the energy flow of system 20 with retort system 120 for oil shale retorting operations (FIG. 4), as shown in FIG. 5, includes nuclear energy 146 generated from nuclear reactor 26. Gas is delivered from gas injection system 134 to hot gas generator 128. Nuclear energy 146 creates thermal energy 132 that is transferred to hot gas generator 128 for producing hot gas 136. Hot gas 136 is delivered to high pressure pumps 130. Pump energy 148 puts hot gas 136 under high pressure.

High pressure pumps 130 deliver hot gas 136 to retort injection wells 138 with sufficient energy 150 to transfer hot gas 136 to the fractured oil shale formations for heat inducement for retort operations. The exposure of the oil shale to heat in connection with high pressure accelerates the maturation of the hydrocarbon precursors, such as kerogen, which forms liquefied and gaseous hydrocarbons. During the retort operations, hydrocarbon products 162 accumulate. Hydrocarbon products 162 are extracted and collected by product recovery system 160. Residual gas from the retorting operations is recovered via a gas recycle system 145 and reinjected to hot gas generator 128 via gas injection system 134. It is envisioned that a gas recovery system is employed to minimize the consumption of gas used to retort the fractured oil shale formation.

Figure 6:
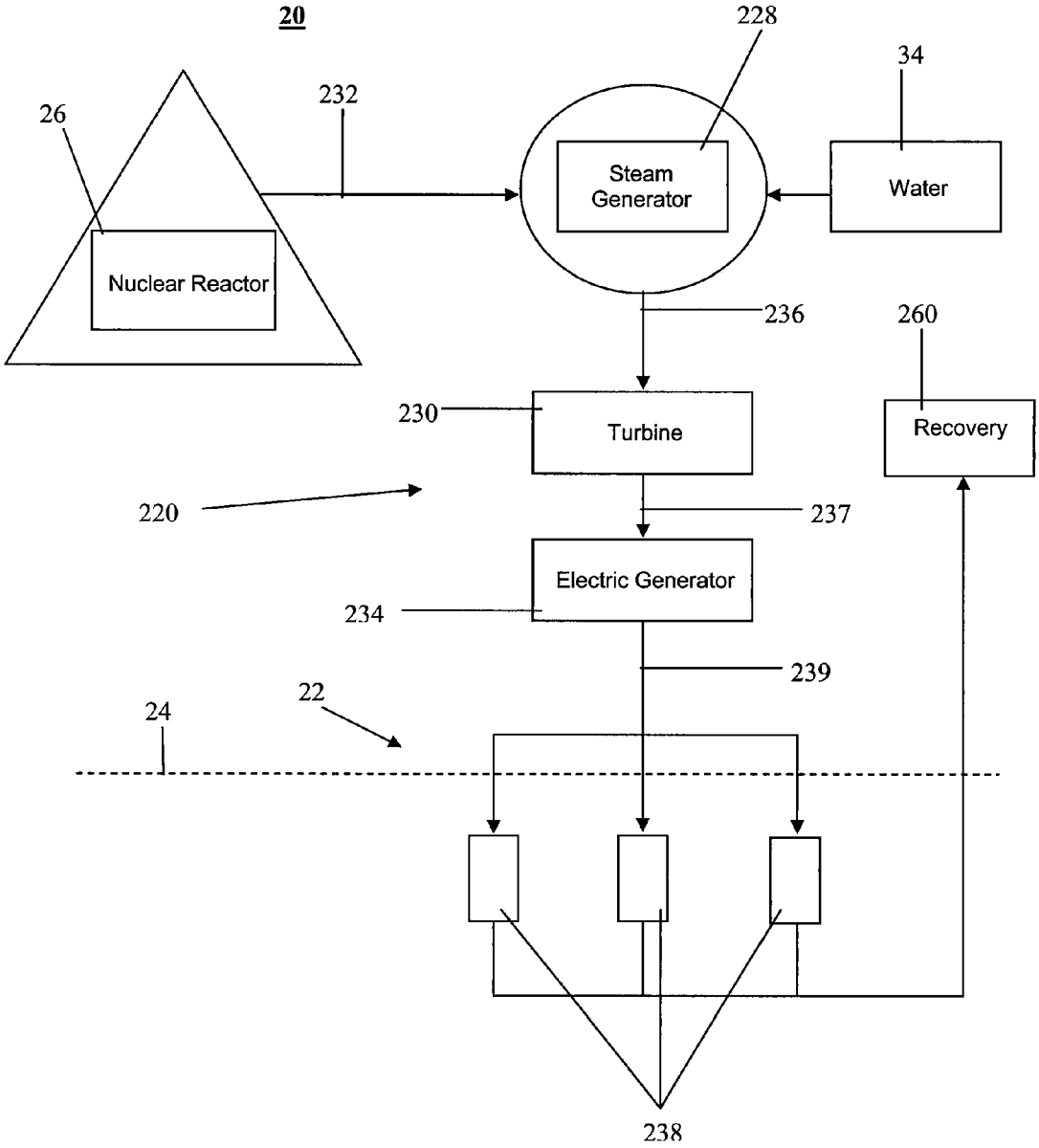
FIG. 6 is a schematic diagram of an alternate embodiment of the method and system shown in FIG. 4.

In an alternate embodiment, as shown in FIG. 6, system 20 includes a retort system 220 for retort operations relating to the fractured oil shale formations at site 22, similar to those described. Site 22 is prepared for installation and related construction of retort system 220, which includes a steam generator and thermal transfer system components, as will be described.

Retort system 220 employs heat generated by electric heaters inserted into holes drilled into the fractured oil shale formations of site 22. The heat generated induces heating of the fractured oil shale formations to accelerate the maturation process of hydrogen precursors, as discussed. Nuclear reactor 26 discussed above, is a thermal source that cooperates with a steam generator 228 to power a steam turbine 230 for generating steam that may be used to drive an electric generator 234 to produce the electric energy to retort the fractured oil shale formation in-situ. If a conventional Pressurized Water Reactor or similar non-boiling water reactor is used a heat exchanger (not shown) may be required. Nuclear reactor 26 is sized to be located at or near site 22 of the fractured oil shale formation. It is envisioned that the electric capacity rating of nuclear reactor 26 is between 50 MWe to 2000 MWe. It is contemplated that the hydrogen generated by nuclear reactor 26 can be used to enhance the value of carbon bearing material, which may resemble char, so it will be recoverable. A hydrogen generator (not shown), either electrolysis, thermal or other may be attached to the nuclear reactor 26 to generate hydrogen for this use.

Water supply 34 delivers water to steam generator 228, which is constructed and installed at site 22. Nuclear reactor 26 is coupled to steam generator 228, as is known to one skilled in the art, for the transfer of thermal energy 232. System 20 employs steam generator 228, in cooperation with nuclear reactor 26 as the thermal source, to produce steam 236 to activate steam turbine 230 for operating an electric generator to provide electric energy for the retort of the fractured oil shale formations. If a conventional Pressurized Water Reactor or similar non-boiling water reactor is used a heat exchanger (not shown) may be required.

Steam generator 228 is coupled to steam turbine 230, in a manner as is known to one skilled in the art. Steam 236 from steam generator 228 flows into steam turbine 230 to provide mechanical energy 237 to an electric generator 234. Steam turbine 230 is coupled to electric generator 234, in a manner as is known to one skilled in the art, and mechanical energy 237 generates current 239 from electric generator 234. It is contemplated that current 239 may include alternating current or direct current.

Current 239 from electric generator 234 is delivered to oil shale asset electric heating retort injection wells 238. Injection wells 238 employ electric resistance heaters (not shown), which are mounted with holes drilled into the fractured oil shale formations of site 22, to promote the retort of the oil shale (See, for example, discussion in "Shell to take 61% stake in China Oil Shale Venture", Green Car Congress, Internet article, Sep. 1, 2005, which is incorporated herein by reference). The electric resistance heaters heat the subsurface of fractured oil shale formations to approximately 343 degrees C. (650 degrees F.) over a 3 to 4 year period. Upon duration of this time period, production of both gaseous and liquefied hydrocarbons are recovered in a product recovery system 260.

Figure 7:
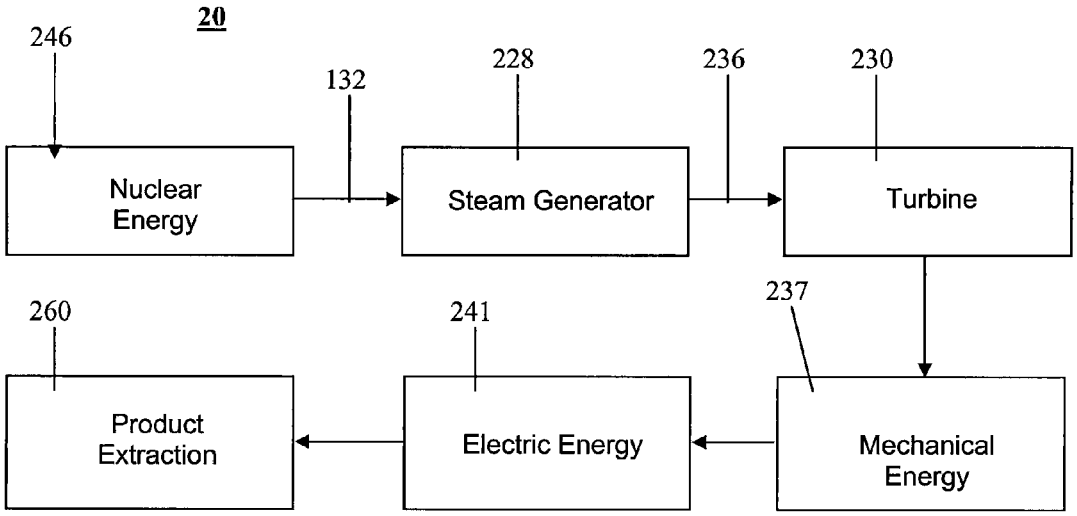
FIG. 7 is a process energy flow diagram of the method and system shown in FIG. 6.

Product recovery system 260 is constructed at site 22. Product recovery system 260 is coupled with injection wells 238 or perforation recovery wells for collection of gaseous and liquefied hydrocarbons that are released during the retort process. An illustration of the energy flow of system 20 with retort system 220 (FIG. 6) for oil shale retorting operations, as shown in FIG. 7, includes nuclear energy 246 generated from nuclear reactor 26. Nuclear energy 246 creates thermal energy 232 that is transferred to steam generator 228 for producing steam 236. If a conventional Pressurized Water Reactor or similar non-boiling water reactor is used a heat exchanger (not shown) may be required. Steam 236 is delivered to steam turbine 230, which produces mechanical energy 237. Mechanical energy 237 generates current 239 from electric generator 234.

Current 239 delivers electric energy 241 to the electric heating elements to heat the fractured oil shale formations for heat inducement. The exposure of the oil shale to heat accelerates the maturation of the hydrocarbon precursors, such as kerogen, which forms liquefied and gaseous hydrocarbons. During the retort operations, hydrocarbon products accumulate. The hydrocarbon products are extracted and collected by product recovery system 260.

Figure 8:
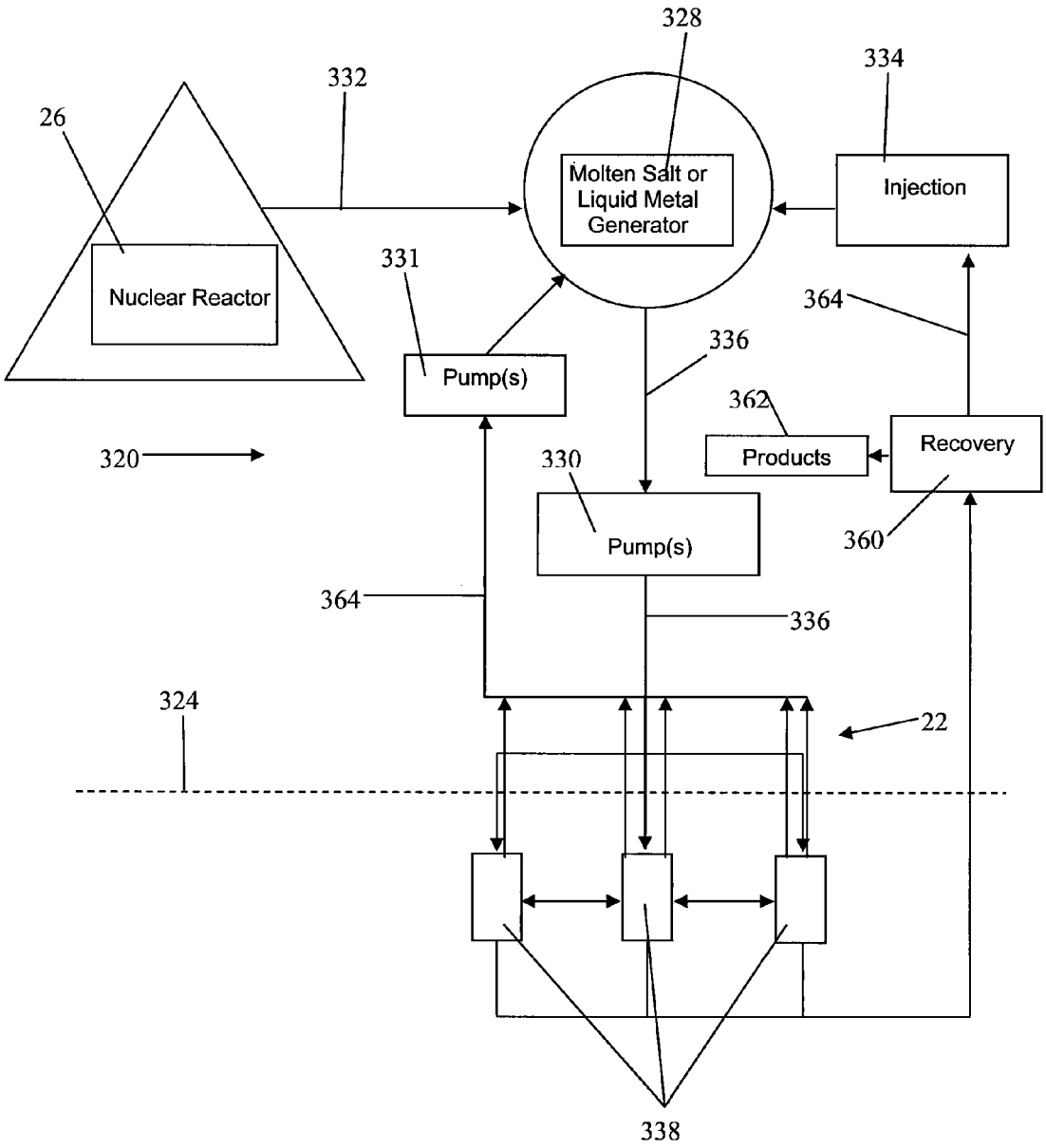
FIG. 8 is a schematic diagram of an alternate embodiment of the method and system shown in FIG. 4.

In another alternate embodiment, as shown in FIG. 8, system 20 includes a retort system 320 for retort operations relating to the fractured oil shale formations at site 22, similar to that described. Site 22 is prepared for installation and related construction of retort system 320, which includes a molten salt or liquid metal generator, bayonet heaters and thermal transfer system components, which will be described.

Retort system 320 employs molten salts or liquid metal, which are injected into the fractured oil shale formations to accelerate the maturation process of hydrocarbon precursors as discussed. Nuclear reactor 26 is a thermal source that provides thermal energy 332 to retort the fractured oil shale formation in-situ. Nuclear reactor 26 is sized to be located at or near site 22 of the fractured oil shale formation. It is envisioned that the thermal rating of nuclear reactor 26 is between 20 MWth to 3000 MWth. It is further contemplated that hydrogen generated by nuclear reactor 26 can be used to enhance the value of carbon bearing material, which may resemble char and be recoverable. A hydrogen generator (not shown), either electrolysis, thermal or other may be attached to the nuclear reactor 26 to generate hydrogen for this use.

A salt injection system 334 is installed at site 22. Salt injection system 334 delivers salts to a molten salt generator 328. Molten salt generator 328 is constructed and installed at site 22. Nuclear reactor 26 is coupled to molten salt generator 328, as is known to one skilled in the art, for the transfer of thermal energy 332. System 20 employs molten salt generator 328, in cooperation with nuclear reactor 26 as the thermal source, to produce molten salt 336 for retort of the fractured oil shale formations.

It is envisioned that the thermal output of nuclear reactor 26 can be used to heat various types of salts for injection to retort the oil shale, such as halide salts, nitrate salts, fluoride salts, and chloride salts. It is further envisioned that liquid metals may be used with retort system 320 as an alternative to salts, which includes the use of a metal injection system and a liquid metal generator. The thermal output of nuclear reactor 26 can be used to heat various types of metals for injection to retort the oil shale, including alkali metals such as sodium.

Pumps 330 are installed at site 22 and coupled to molten salt generator 328 for injecting molten salt 336 into the fractured oil shale formations. Pumps 330 are coupled to oil shale asset heating retort injection wells 338 to deliver molten salt 336 for the retort of the fractured oil shale formations. It is envisioned that system 20 may include various pump configurations including multiple pumps to maximize the effectiveness of the retort operation. It is further envisioned that pumps 331 may be employed to recover residual molten salt, after retort operations, for return to molten salt generator 328, as part of the recovery and recycling system of retort system 320 discussed below.

Oil shale asset heating retort injection wells 338 are installed with the infrastructure of system 20, as discussed. Molten salt 336 is transferred to injection wells 338 and injected into the fractured oil shale formation. The use of horizontal drilling described with regard to FIG. 3, can be employed to maximize the oil shale formation's exposure to heat necessary to form both gaseous and liquefied hydrocarbons. It may take between 2-4 years for the formation of sufficient kerogen to be commercially recoverable. After that recovery may occur on a commercial level for between 3-30 years or more.

Figure 9:
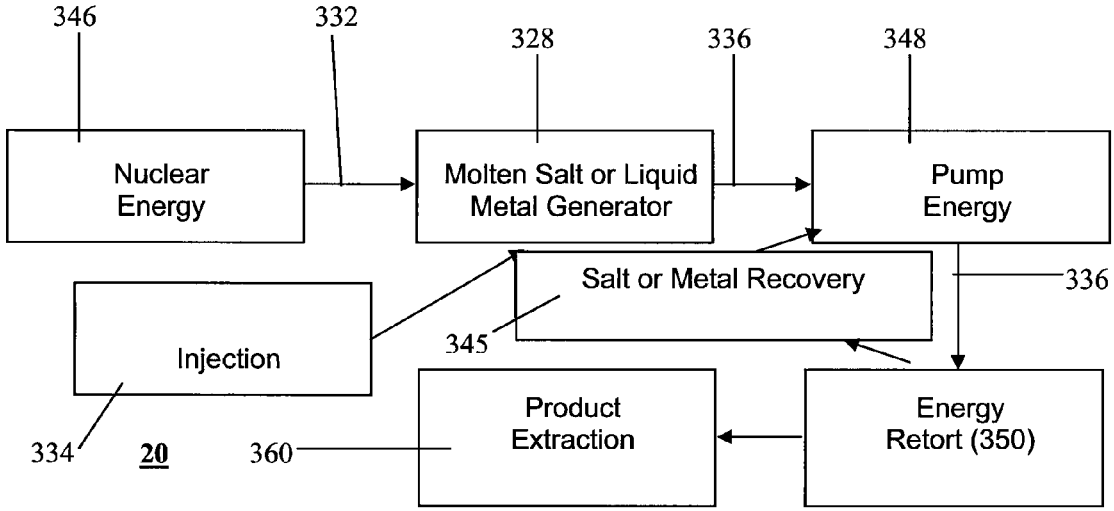
FIG. 9 is a process energy flow diagram of the method and system shown in FIG. 8.

A product recovery system 360 is constructed at site 22. Product recovery system 360 may be coupled with injection wells 338 for collection of gaseous and liquefied hydrocarbons that are released during the retort process or may be perforation recovery wells. An illustration of the energy flow of system 20 with retort system 320 (FIG. 8) for oil shale retorting operations, as shown in FIG. 9, includes nuclear energy 346 generated from nuclear reactor 26. Salt is delivered from salt injection system 334 to molten salt generator 328.

Nuclear energy 346 creates thermal energy 332 that is transferred to molten salt generator 328 for producing molten salt 336. Molten salt 336 is delivered to pumps 330 and pump energy 348 delivers molten salt 336 to retort injection wells 338 with sufficient energy 350 to transfer molten salt 336 to the fractured oil shale formations for heat inducement. The exposure of the oil shale to heat accelerates the maturation of the hydrocarbon precursors, such as kerogen, which forms liquefied and gaseous hydrocarbons. During the retort operations, hydrocarbon products 362 accumulate. Hydrocarbon products 362 are extracted and collected by product recovery system 360. Residual molten salt 364 from the retorting operations are recovered via a salt recovery system 345 and reinjected to molten salt generator 328 via pumps 331 and salt injection system 334. It is envisioned that salt recovery system 345 is employed to minimize the consumption of salt used to retort the fractured oil shale formation.

Figure 10:
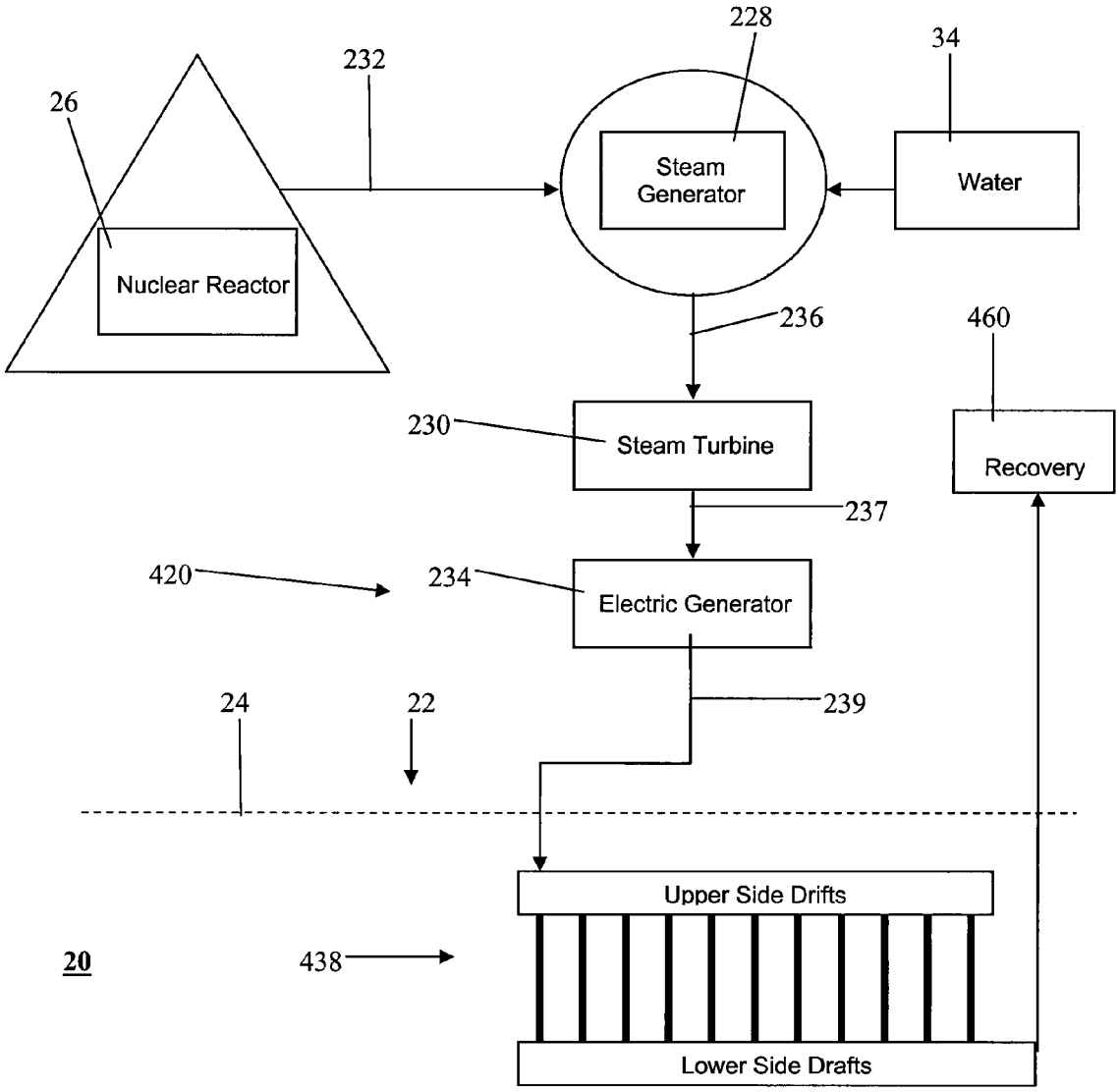
FIG. 10 is a schematic diagram of an alternate embodiment of the method and system shown in FIG. 4.

In another alternate embodiment, as shown in FIG. 10, system 20 includes a retort system 420 for retort operations relating to the fractured oil shale formations at site 22, similar to those described. Site 22 is prepared for installation and related construction of retort system 420, which includes a steam generator, oscillators and thermal transfer system components, as will be described.

Retort system 420 employs heat generated by oscillators, which are mounted with the fractured oil shale formations of site 22. The heat generated induces heating of the fractured oil shale formations to accelerate the maturation process of hydrogen precursors, as discussed. Nuclear reactor 26 discussed above, is a thermal source that cooperates with a steam generator 228 to power a steam turbine 230 for generating the electric energy to retort the fractured oil shale formation in-situ. Nuclear reactor 26 is sized to be located at or near site 22 of the fractured oil shale formation. It is envisioned that the electric capacity rating of nuclear reactor 26 is between 50 MWe to 3000 MWe. It is contemplated that the hydrogen generated by nuclear reactor 26 can be used to enhance the value of carbon bearing material, which may resemble char, so it will be recoverable. A hydrogen generator (not shown), either electrolysis, thermal or other may be attached to the nuclear reactor 26 to generate hydrogen for this use.

Water supply 34 delivers water to steam generator 228, which is constructed and installed at site 22. Nuclear reactor 26 is coupled to steam generator 228, in a manner as is known to one skilled in the art, for the transfer of thermal energy 232. System 20 employs steam generator 228, in cooperation with nuclear reactor 26 as the thermal source, to produce steam 236 to activate steam turbine 230 for retort of the fractured oil shale formations.

Steam generator 228 is coupled to steam turbine 230, in a manner as is known to one skilled in the art. Steam 236 from steam generator 228 flows into steam turbine 230 to provide mechanical energy 237 to an electric generator 234. Steam turbine 230 is coupled to electric generator 234, and mechanical energy 237 generates current 239 from electric generator 234. It is contemplated that current 239 may include alternating current or direct current.

Current 239 from electric generator 234 is delivered to oscillators 438. The electric power delivered to oscillators 438 via current 239 creates a radio frequency having a wavelength where the attenuation is compatible with the well spacing to provide substantially uniform heat.

Figure 11:
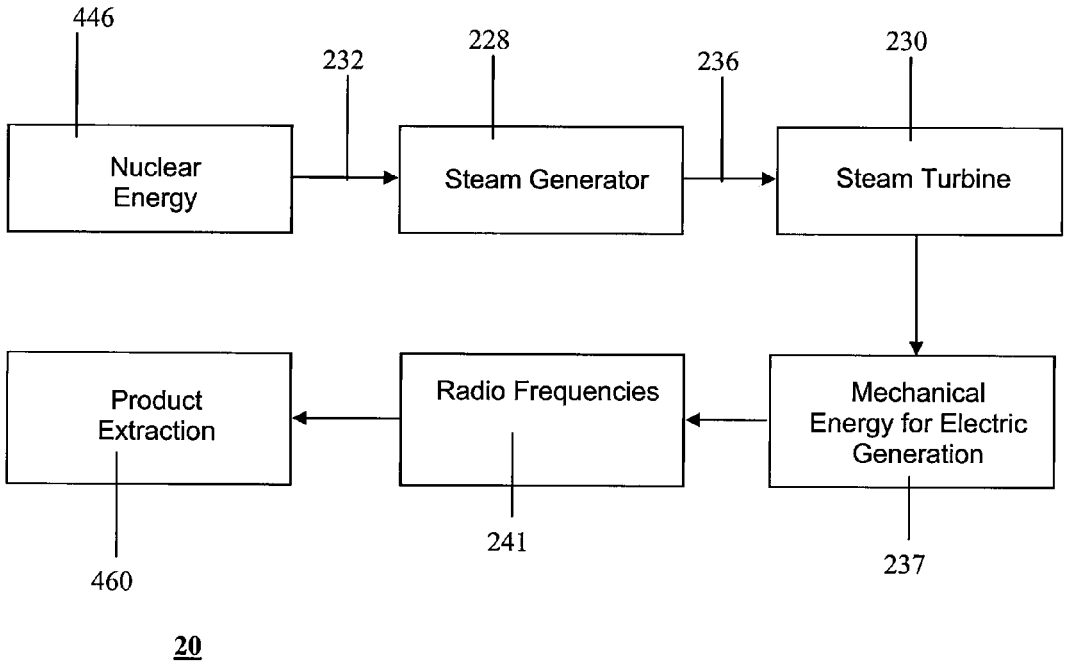
FIG. 11 is a process energy flow diagram of the method and system shown in FIG. 10.

A product recovery system 460 is constructed at site 22. Product recovery system 460 is connected with the recovery wells for collection of gaseous and liquefied hydrocarbons that are released during the retort process. An illustration of the energy flow of system 20 with retort system 420 (FIG. 10) for oil shale retorting operations, as shown in FIG. 11, includes nuclear energy 446 generated from nuclear reactor 26. Nuclear energy 446 creates thermal energy 232 that is transferred to steam generator 228 for producing steam. Steam 236 is delivered to steam turbine 230, which produces mechanical energy 237. Mechanical energy 237 generates current 239 from electric generator 234.

Current 239 delivers electric energy to oscillators 438 to create radio frequencies 241 to heat the fractured oil shale formations for heat inducement. The exposure of the oil shale to heat accelerates the maturation of the hydrocarbon precursors, such as kerogen, which forms liquefied and gaseous hydrocarbons. During the retort operations, hydrocarbon products accumulate. The hydrocarbon products are extracted and collected by product recovery system 460.

It will be understood that various modifications may be made to the embodiments disclosed herein. Therefore, the above description should not be construed as limiting, but merely as exemplification of the various embodiments. Those skilled in the art will envision other modifications within the scope and spirit of the claims appended hereto.

What is claimed is:

1. A method for recovering hydrocarbon products, the method comprising the steps of:

producing thermal energy using a nuclear reactor operatively connected to a steam generator;

providing said thermal energy to said steam generator;

providing water to said steam generator;

producing steam from said steam generator;

injecting said steam into a steam turbine to generate mechanical energy;

providing said mechanical energy to an electric generator;

generating current from said electric generator from said mechanical energy;

powering electric resistance heaters with said current, said heaters being disposed with injection wells wherein said injection wells are disposed in an oil shale formation;

retorting oil shale in said oil shale formation using heat from said heaters to produce hydrocarbon products; and extracting said hydrocarbon products from said injection wells.

2. A method as recited in claim 1, further comprising the step of constructing an infrastructure in said oil shale formation, said infrastructure being formed by horizontal and vertical direction drilling in a configuration to increase permeability and porosity of said oil shale formation.

3. A method as recited in claim 1, wherein the step of extracting includes a product recovery system coupled to said injection wells in a configuration for collection of gaseous and liquefied hydrocarbons released during the step of retorting.

* * * * *